US006142915A

United States Patent [19]

Eschenbach

[11] Patent Number: 6,142,915

[45] Date of Patent: Nov. 7, 2000

[54] STANDUP EXERCISE APPARATUS WITH PEDAL ARTICULATION

[76] Inventor: Paul William Eschenbach, 143 Lakeland Ave., Moore, S.C. 29369

[21] Appl. No.: 09/067,261

[22] Filed: Apr. 27, 1998

Related U.S. Application Data

[63] Continuation-in-part of application No. 08/711,087, Sep. 9, 1996, Pat. No. 5,788,610.

[51] Int. Cl.[7] ..... A63B 69/16; A63B 22/04

[52] U.S. Cl. ..... 482/52; 482/57; 482/70

[58] Field of Search ..... 482/51, 52, 53, 482/57, 62, 70, 71, 79, 80

[56] References Cited

U.S. PATENT DOCUMENTS

| | | | |
|---|---|---|---|
| 219,439 | 9/1879 | Blend | 482/51 |
| 5,290,211 | 3/1994 | Stearns | 482/52 |
| 5,433,680 | 7/1995 | Knudsen | 482/57 |
| 5,518,473 | 5/1996 | Miller | 482/51 |
| 5,529,555 | 6/1996 | Rodgers | 482/57 |
| 5,562,574 | 10/1996 | Miller | 482/51 |
| 5,573,480 | 11/1996 | Rodgers | 482/57 |
| 5,577,985 | 11/1996 | Miller | 482/52 |
| 5,788,610 | 8/1998 | Eschenbach | 482/52 |

*Primary Examiner*—Stephen R. Crow

[57] ABSTRACT

A standup exercise apparatus simulates walking and jogging with arm exercise. Foot pedals move with heel and toe curves inclined in opposing directions. The pedals incline with the toe above the heel during the latter portion of forward movement of the foot while the heel inclines above the toe during the latter portion of rearward movement of the foot. Foot pedals move with smooth elliptical motion resulting from a linkage mechanism guiding one foot support member pivot and a rocker link to support the other foot support member pivot. The pedal is is pivoted to one end of the foot support member and articulates the pedal angle separately from the foot support member. Leg joint impact is controlled to be very low as to allow extended exercise without joint soreness. Arm exercise is coordinated with motion of the feet.

17 Claims, 5 Drawing Sheets

STANDUP EXERCISE APPARATUS WITH PEDAL ARTICULATION

RELATED APPLICATION

This is a continuation in part of application Ser. No. 08/711,087 filed Sep. 9, 1996, now U.S. Pat. No. 5,788,610.

BACKGROUND OF THE INVENTION

1. Field

The present invention relates to a standup exercise apparatus that simulates walking and jogging with arm exercise. More particularly, the present invention relates to an exercise machine having separately supported articulating pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Various attempts to provide a walking motion during standup pedal exercise are on the market today which provide a pendulum motion to the feet similar to Bull et al. in U.S. Pat. No. 4,940,233 that shows a swing arm with pedal attached so the foot reciprocates along an arcuate path. These swinger type exercise apparatus do not simulate a true walking motion because the foot returns along the same arcuate path without lifting as in actual walking. There is a need for a standup exercise apparatus having pedals which guide the heel and toe of the feet along separate elongate curve paths while inclining the feet as experienced during walking. There is a further need to combine arm exercise with the improved walking motion.

Hand cranks and swing arms have long been applied to arm exercise. More recently swing arms have been more popular in commercial and home exercise equipment.

Swing arms for arm exercise are used by Carlson et al. in U.S. Pat. No. 4,772,015 to arm wrestle while Carlson in U.S. Pat. No. 4,720,099 adapts swing arms for a variety of arm and leg motions in one machine. Iams et al. in U.S. Pat. No. 4,674,740 applies spring loaded handles in a prone platform supporting position to simulate the arm motion of swimming. Berne in U.S. Pat. No. 2,921,791 and McGillis et al. in U.S. Pat. No. 4,872,668 use articulated arms for various arm exercise.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup pedaling approaches the benefits of running to the cardiovascular system because a higher load resistance is possible over sit down cycling. Dr. Cooper in his book entitled THE AEROBICS PROGRAM FOR TOTAL WELL-BEING by Dr. Kenneth Cooper, Bantam Books, New York, 1982 awards only half the benefit points to sit down stationary cycling (page 260) over regular cycling which includes an equal amount of uphill and down hill course (page 255). Dr. Cooper grades running better than regular cycling, but without the downhill rest inherent in regular cycling, it is certain that standup cycling with vigorous arm exercise would exceed running for cardiovascular benefits in less time.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

A Passive-Motion Walking-Machine is shown by Blend in U.S. Pat. No. 219,439 having foot pedals guided by rollers which follow a curved track. Both front and rear pivots follow the same path as the foot pedal moves forward until the front rollers reach a switch plate at the forward end of the pedal cycle. The front rollers move up the inclined switch plate to roll over the rounded end to drop upon a lower track to begin the return cycle to the rear. Since the front rollers use the same track or guide path as the rear rollers through most of the pedal cycle, the pedal pivots are not guided by two separate different pivot guide curves. Furthermore, the switch plate is unidirectional for a non-reversable pedal cycle. It is an object of this invention to guide the pedals with walking motion where the feet incline as in walking with the heel above the toe in the rearward portion of the foot motion while the toe is above the heel during the forward portion of the foot motion.

Recently, several elliptical exercise machines have appeared in the patent literature. Rogers,Jr. in U.S. Pat. Nos. 5,529,555, 5,540,637 and 5,549,526 shows elliptical pedal motion by virtue of various reciprocating members and a geared linkage system. Miller in U.S. Pat. Nos. 5,518,473 and 5,562,574 also shows elliptical pedal motion using reciprocating members and slider-crank mechanisms. Additional patents by Miller in U.S. Pat. Nos. 5,577,985 and 5,611,756 deal with elliptical pedal motion using oscillating guide links with control links to determine foot support angles.

The Elliptical Cross Trainer by Life Fitness of Franklin Park Ill. also generates elliptical pedal motion using an elongated pedal supported by rollers on one end and a crank having orthogonal slots with rollers on the other. Maresh in U.S. Pat. No. 5,707,321 shows elongate pedal curves having pedals free to rotate about a single pedal pivot and parallel motion pedals. None of these elliptical exercise machines anticipate pedal articulation common to walking of the present invention.

It is one objective of this invention to provide a linkage system that causes the pedal to move along elongate heel and toe curves that are inclined in opposing directions. Another object of this invention is to provide pedals that incline the foot to simulate walking or jogging.

There is a need for a pedal operated quiet exercise machine that can be safely operated in the standup position whereby the arms and legs can be exercised with the feet moving through a generally elliptical path that is different for the heel and the toe while the pedals move with a smoothly changing angular motion during the pedal cycle.

SUMMARY OF THE INVENTION

The present invention relates to the kinematic motion control of pedals which simulate walking and jogging during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion that is significantly different for the toe and the heel while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal being pivotally supported by a foot support link which is pivotally attached to a first rocker link being pivoted to the framework. The foot support link is also pivotally attached to a triangular coupling link that is pivotally attached to a rotary crank and a second rocker link that is pivotally attached to the framework. The crank for one foot completes one full revolution during a pedal cycle and is phased generally opposite the crank for the other foot support link through a bearing journal attached to the framework. A connector link is pivotally connected to the pedal and to the first rocker link. Arm exercise is coordinated with the pedal motion by upward extension of the second rocker links.

In an alternate embodiment, the same number of links are used but the coupler link is linear instead of triangular. Arm exercise occurs with extensions of the first rocker links.

In both embodiments, the pedal is moved by the foot of the user where the toe end of the pedal follows an inclined forward elongate curve path and the heel follows an elongate curve that is inclined to the rear while the connector link inclines the pedal with the heel above the toe during the rearward portion of the heel elongate curve path and inclines the foot with the toe above the heel during the forward portion of the toe elongate curve path.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

In summary, this invention provides the operator with stable foot pedal support having motions that simulate walking and jogging with very low joint impact while offering naturally inclining pedal motion and upper body exercise.

DETAILED DESCRIPTION OF THE EMBODIMENTS

Figure 1:
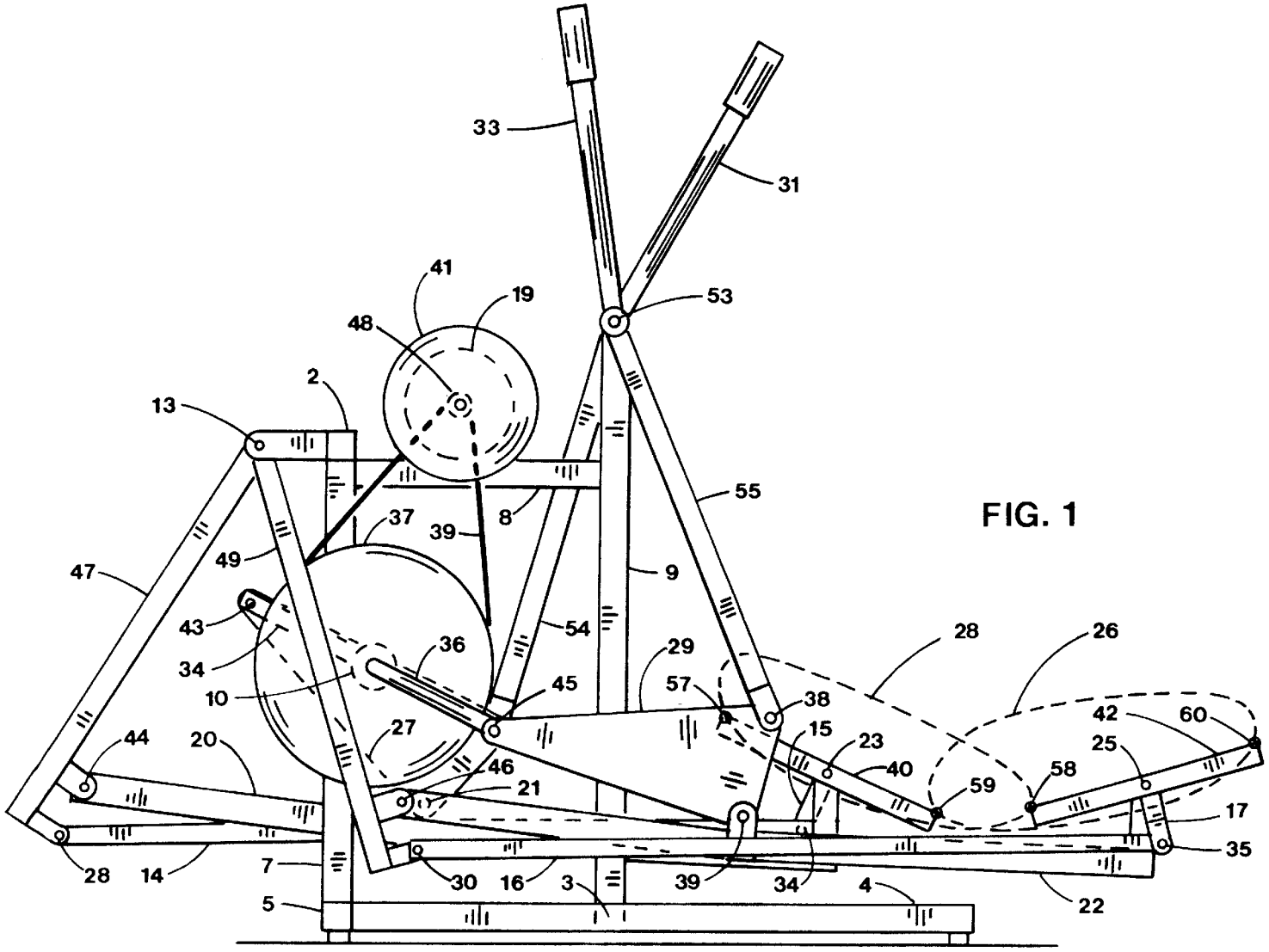
FIG. 1 is a right side elevation view of the preferred embodiment of an exercise machine constructed in accordance with the present invention.
Figure 2:
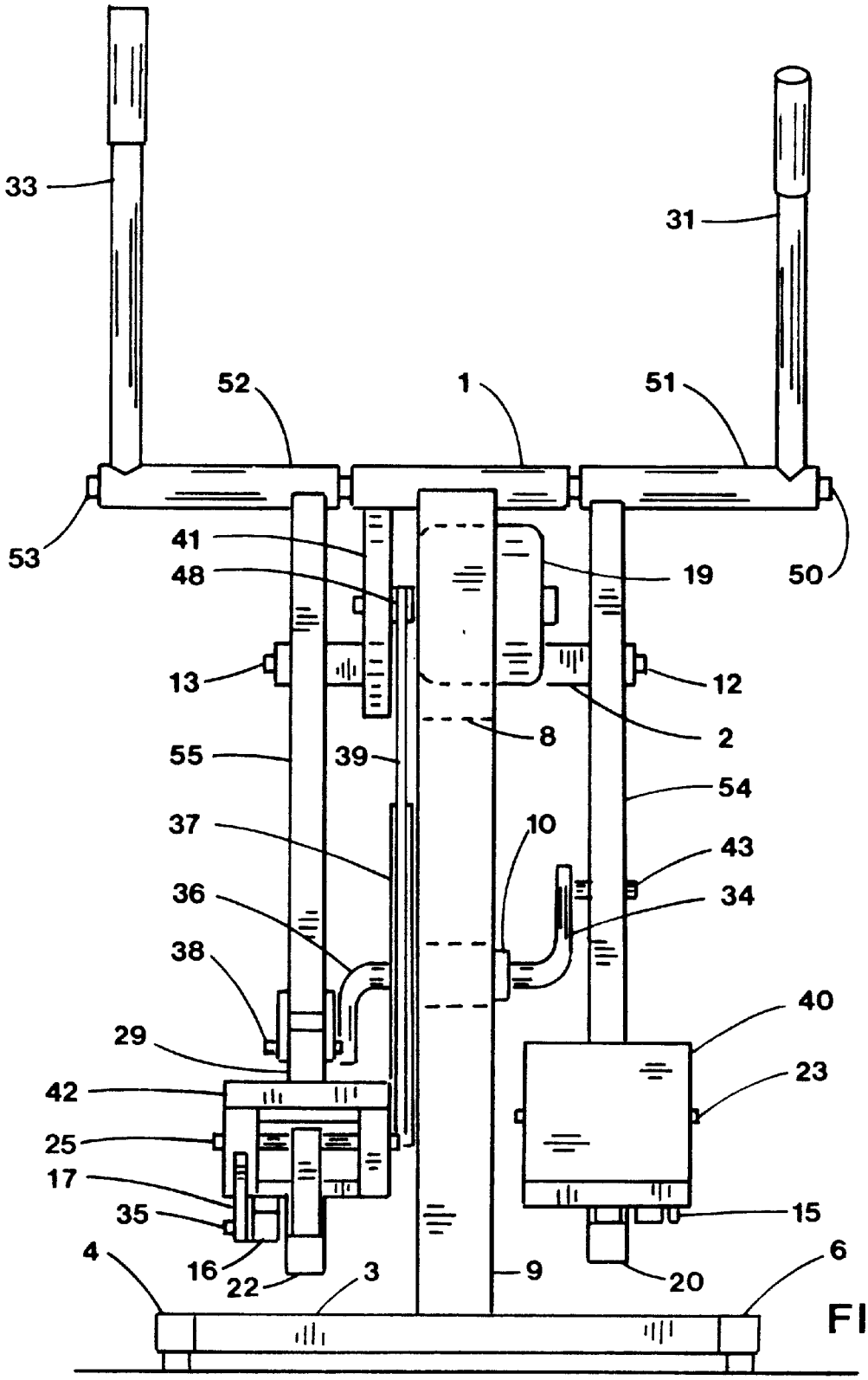
FIG. 2 is the rear view of the preferred embodiment shown in FIG. 1.

Referring to the drawings in detail, pedals 40 and 42 are shown in FIGS. 1 and 2 in the most forward and rearward positions of the preferred embodiment. Pedals 40 and 42 are are pivoted to foot support links 20,22 at pivots 23,25. Foot support links 20,22 are connected to coupler links 27,29 at pivots 21,39 and are connected to rocker links 47,49 at pivots 44,46 at one end. Rocker links 47,49 are connected to frame crossover member 2 at pivots 12,13.

Cranks 34,36 are joined inside bearing housing 10 and protrude outward in generally opposing directions being connected to coupler links 27,29 at pivots 43,45. Rocker links 54,55 are pivoted to frame member 1 at pivots 53,50 and connected to coupler links 27,29 at pivot 38. Pedal extensions 15,17 are connected to rocker links 47,49 by connector links 14,16 at pivots 34,35 and 28,30. Arm levers 31,33 are attached to rocker extensions 51,52 that are attached to rockers 54,55.

Frame member 4,6 are connected by cross members 3,5 and are configured to contact the floor for support of the exercise machine. Upper frame supports 7,9 attach to crossover members 3,5 and are connected by frame member 8. Frame member 7 supports crank bearing housing 10.

Load resistance is imposed upon cranks 34,36 by pulley 37 which drives flywheel 41 and alternator 19 with suitable electric control by belt 39 coupled to pulley 48. Alternator 19 is attached to frame member 8.

Application of body weight on the pedals 40,42 causes the pedal toe end 57,58 to follow elongate curve path 28 while pedal heel ends 59,60 follow elongate curve path 26 as shown in FIG. 1. Body weight on the pedals 40,42 together with force applied at the arm levers 31,33 cause the linkage to rotate the flywheel 41 for a gain in momentum. This flywheel 41 momentum will carry the linkage system through any dead center positions of the crank 34,36. The pedals 40,42 and arm levers 31,33 can be operated to drive the flywheel 41 in either direction of rotation.

Figure 3:
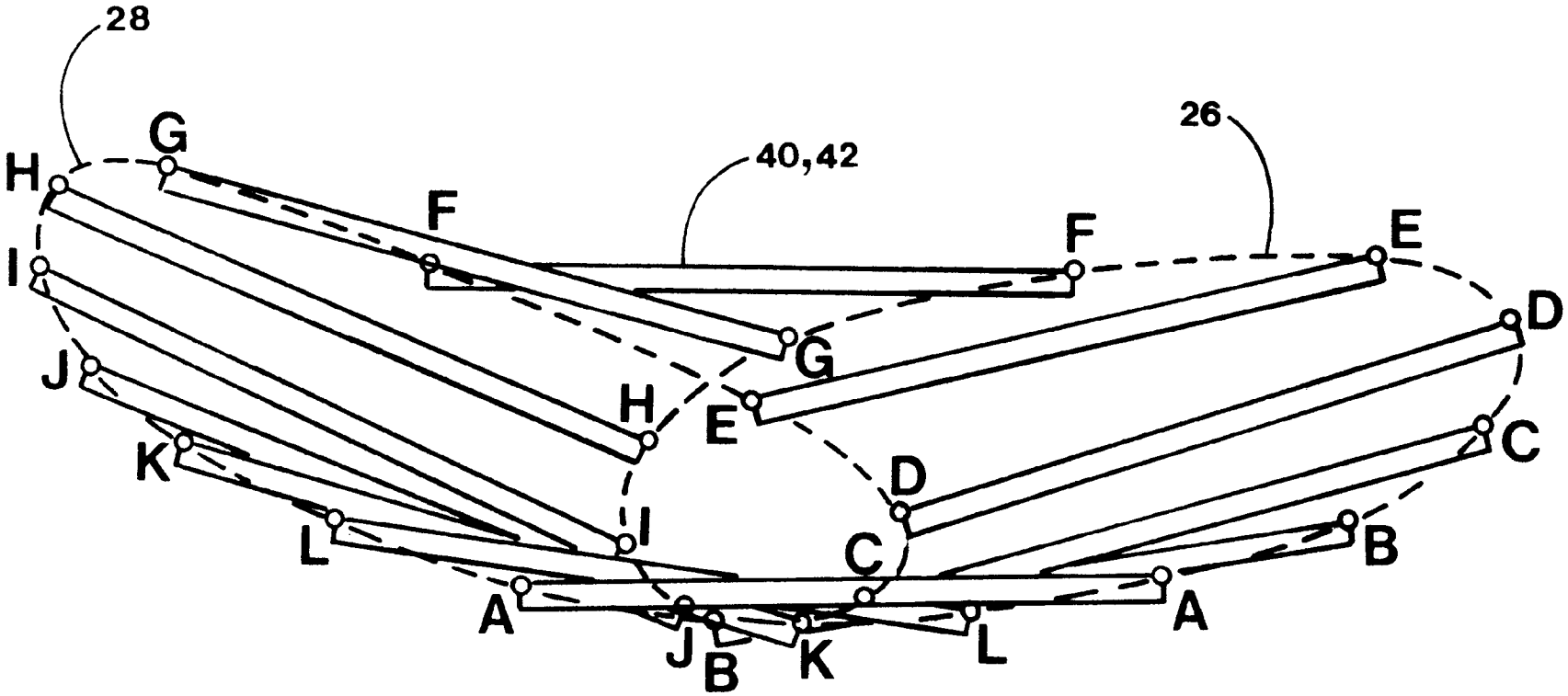
FIG. 3 is a sequence of pedal toe and heel positions for the preferred embodiment.

FIG. 3 shows pedal positions A—A to L—L as the pedal follows toe curve 28 and heel curve 26. Both elongate curves

26,28 are generally elliptical in shape. The toe curve 28 is inclined towards the front while the heel curve 26 is inclined towards the rear. From the most forward position I—I through L—L, the toe lowers faster than the heel while with positions B—B through D—D, the heel rises faster than the toe. Pedals 40,42 incline the toe of the foot below the heel in rearward positions B—B through E—E and inclines the toe above the heel in forward positions G—G through L—L. Positions A—A and F—F are generally horizontal in the midsections of the elongate curves 26,28. The angular articulation of pedals 40,42 more closely simulates the motions of walking than previous elliptical exercise machines.

Figure 4:
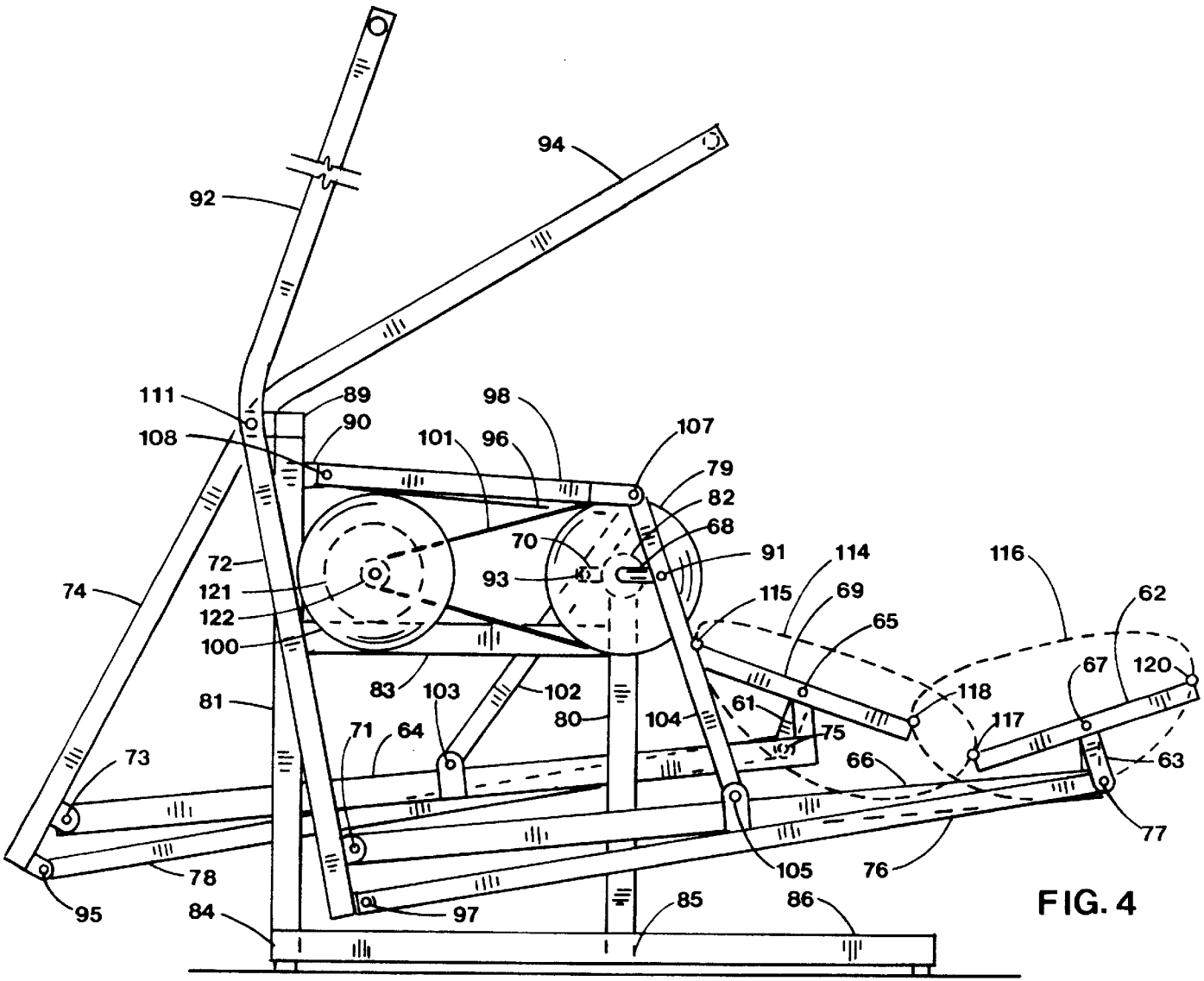
FIG. 4 is a right side elevation of the alternate embodiment.
Figure 5:
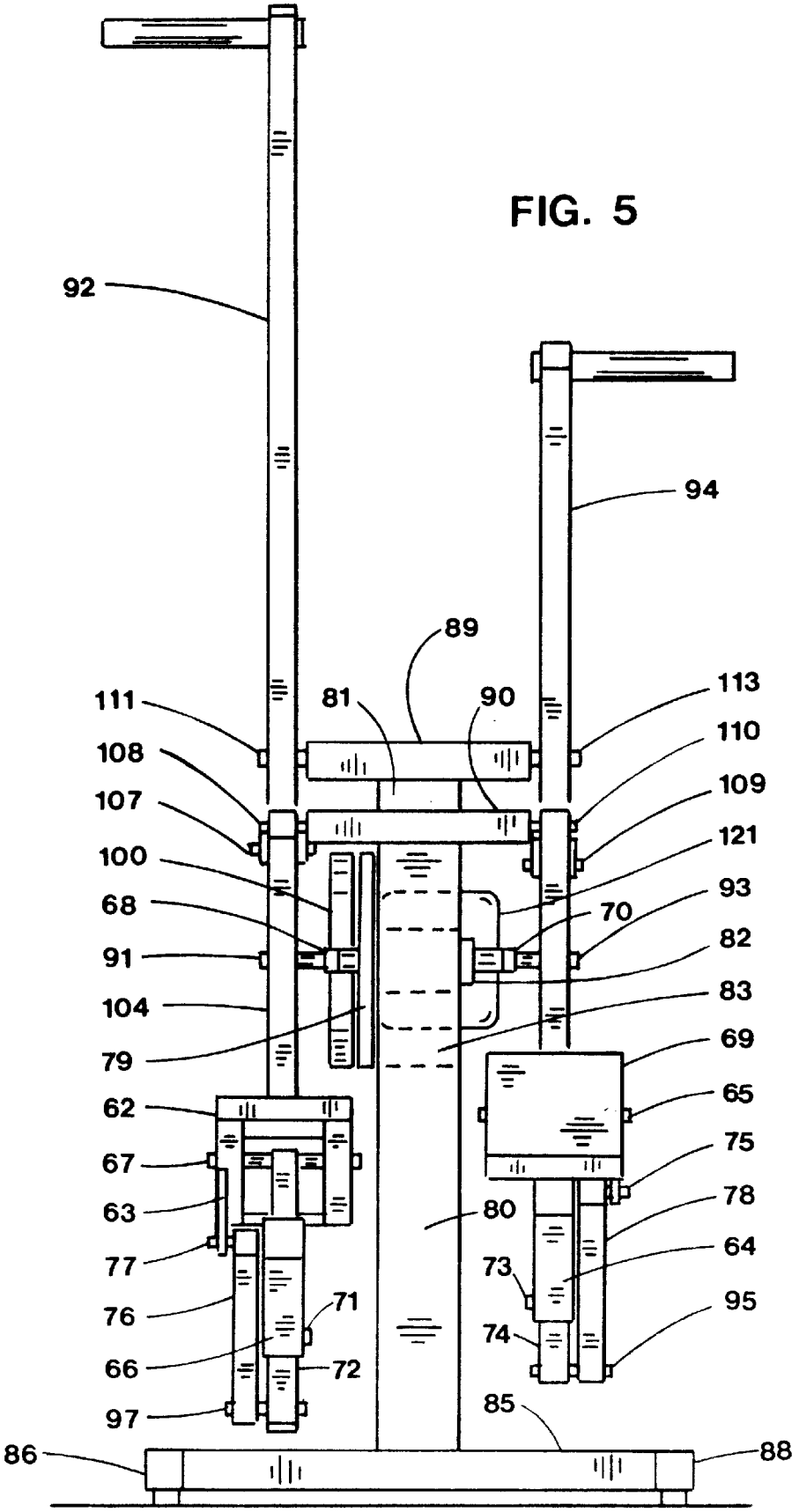
FIG. 5 is the rear view of the alternate embodiment shown in FIG. 4.

An alternate embodiment is shown in FIG. 4 with pedals 69,62 in their most forward and rearward positions. Pedals 69,62 are pivoted to foot support links 64,66 at pivots 65,67. Foot support links 64,66 are attached to coupler links 102,104 at pivots 103,105 and to rockers 74,72 at pivots 73,71 which are attached to the frame member 89 by pivots 113,111.

Cranks 68,70 are connected inside bearing housing 82 and project outward in generally opposite directions. Coupler links 102,104 are connected to cranks 68,70 at pivots 91,93 and to rockers 96,98 at pivots 109,107. Rockers 96,98 are attached to frame member 90 at pivots 110,108. Pedal extensions 61,63 are coupled to connector links 78,76 at pivots 75,77. The connector links 78,76 are connected to rockers 74,72 at pivots 95,97. Handles 92,94 are extensions of rockers 72,74 for arm exercise coordinated with pedals 69,62.

Bearing housing 82 is connected to upright frame member 80 which is connected to crossover members 83,85. Upright frame member 81 is connected to members 83,84,89 and 90. Side members 86,88 are configured to be supported by the floor and are connected by crossover members 84 and 85.

Pedal toe ends 115,117 trace toe curve 114 while pedal heel ends 118,120 trace heel curve 116. Intermediate pedal positions are similar to those shown in FIG. 3. Toe curve 114 is inclined forward while heel curve 116 is inclined towards the rear.

Load resistance is provided by alternator 121 with suitable electrical resistance and flywheel 100. Pulley 122 is attached to flywheel 100 and couples pulley 79 by belt 101. Pulley 79 is connected to crank 68.

Application of body weight upon pedals 69,62 and arm force upon handles 92 and 94 produce the elongate curve paths 114 and 116 with pedal positions similar to the first embodiment as shown in FIG. 3.

In summary, the present invention has distinct advantages over prior art because the angular articulation of the pedals more closely simulate the foot motions of walking than previous elliptical exercise machines offered.

What is claimed is:

1. An exercise machine comprising;

a framework means, said framework means configured to be supported on the floor;

a pair of foot support means, each having a first and a second foot support pivot means;

a crank means, said crank means rotatably attached to said framework means, said crank means projecting outwardly therefrom on both sides thereof;

a linkage means, said linkage means having a plurality of links operably associated with said framework means including said crank means and a pivot means, said pivot means attached to said first foot support pivot means;

a rocker means, said rocker means pivotally connected to said framework means and to said second foot support means;

a connector link means pivotally connected to said rocker means;

a pedal means having a toe and a heel end, said pedal means pivotally connected to said foot support means and operably associated with said connector link means;

said pedal means configured to move relative to said foot support means when the foot of the user is rotating said crank means whereby said pedal means movement causes the toe end of said pedal means to follow a first elongate curve path with the forward portion inclined upward and the heel end of said pedal means to follow a second elongate curve path with the rearward portion inclined upward to simulate a walking motion.

2. The exercise machine according to claim 1 wherein said linkage means includes a rocker means pivotally connected to said framework means and pivotally connected to a coupler link means, said coupler link means pivotally connected to said crank means and to said foot support means at said pivot means.

3. The exercise machine according to claim 1 wherein said pedal means movement causes the rear lowermost portion of said first elongate curve and the front lowermost portion of said second elongate curve to overlap.

4. The exercise machine according to claim 1 wherein said pedal means further comprises a foot engaging portion and a pedal link extension pivotally attached to said connector link means, said pedal means attached to said foot support means at one end.

5. The exercise machine according to claim 1 further comprising an arm exercise means operably associated with said linkage means.

6. The exercise machine according to claim 1 further comprising an arm exercise means operably associated with said rocker means.

7. The exercise machine according to claim 1 further comprising a load resistance means operably associated with said crank means.

8. An exercise machine comprising;

a framework means, said framework means configured to be supported on the floor;

a linkage means, said linkage means having a plurality of links operably associated with said framework means including a crank means rotatably attached to said framework means, said crank means projecting outwardly therefrom on both sides thereof;

a pedal means having a toe end and a heel end to support each foot, said pedal means operably associated with said linkage means, said linkage means includes a rocker means pivotally connected to said framework means and pivotally connected to said pedal means wherein the toe end follows a first closed loop curve path and the heel end follows a second closed loop curve path, said pedal means coordinated with said linkage means to allow said pedal means to move relative to said framework means when the foot of the user is rotating said linkage means whereby said pedal means causes the foot to incline with the heel generally below the toe during generally the forward portion of said first closed loop curve path and causing the foot to incline with the heel generally above the toe during generally the rearward portion of said second closed loop curve path.

9. The exercise machine according to claim 8 wherein said linkage means includes a connector link pivotally interposed between said pedal means and said rocker means.

10. The exercise machine according to claim 8 wherein said linkage means includes a coupler link pivotally connected to said crank means and a second rocker means, said coupler link means operably associated with said pedal means.

11. The exercise machine according to claim 10 wherein said pedal means is pivotally attached to said pedal means at one end and having a pedal extention pivotally attached to said connector link means.

12. The exercise machine according to claim 8 further comprising an arm exercise means operably associated with said linkage means.

13. The exercise machine according to claim 8 further comprising an arm exercise means operably associated with said rocker means.

14. An exercise machine comprising;

a framework means, said framework means configured to be supported on the floor;

a linkage means, said linkage means having a plurality of links operably associated with said framework means including a crank means rotatably attached to said framework means, said crank means projecting outwardly therefrom on both sides thereof;

a pedal means having a toe end and a heel end to support each foot, said pedal means operably associated with said linkage means, said linkage means includes a rocker means pivotally connected to said framework means and pivotally connected to said pedal means wherein the toe end follows a first closed loop curve path and the heel end follows a second closed loop curve path, said pedal means coordinated with said linkage means to allow said pedal means to move relative to said framework means when the foot of the user is rotating said linkage means whereby said pedal means causes the toe of the foot to lower faster than the heel during substantially the lower forward portion of said first closed loop curve path and causing the heel of the foot to rise faster than the toe during substantially the lower rearward portion of said second closed loop curve path.

15. The exercise machine according to claim 14 wherein said linkage means includes a connector link means pivotally interposed between said pedal means and said rocker means.

16. The exercise machine according to claim 14 wherein said linkage means includes a coupler link means pivotally connected to said crank means and a second rocker means, said coupler link means operably associated with said pedal means.

17. The exercise machine according to claim 14 further comprising an arm exercise means operably associated with said linkage means.

* * * * *